US008616928B2

(12) United States Patent
Uchiyama

(10) Patent No.: US 8,616,928 B2
(45) Date of Patent: Dec. 31, 2013

(54) TERMINAL FITTING AND A METHOD FOR FORMING A FLUID-PROOF TERMINATED WIRE ASSEMBLY

(75) Inventor: Yoshihiro Uchiyama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 6 days.

(21) Appl. No.: 13/361,161

(22) Filed: Jan. 30, 2012

(65) Prior Publication Data

US 2012/0202394 A1 Aug. 9, 2012

(30) Foreign Application Priority Data

Feb. 7, 2011 (JP) ..... 2011-024092

(51) Int. Cl.
*H01R 4/10* (2006.01)

(52) U.S. Cl.
USPC ..... 439/877; 439/936

(58) Field of Classification Search
USPC ..... 439/877–882, 936; 29/863; 174/84 C
See application file for complete search history.

(56) References Cited

U.S. PATENT DOCUMENTS

| | | | | |
|---|---|---|---|---|
| 5,316,506 | A | 5/1994 | Ito | |
| 2004/0137801 | A1 | 7/2004 | Quillet et al. | |
| 2010/0200261 | A1 | 8/2010 | Boutot | |
| 2010/0297894 | A1 * | 11/2010 | Ootsuka et al. | 439/877 |

FOREIGN PATENT DOCUMENTS

| | | | |
|---|---|---|---|
| FR | 2920599 | A1 * | 3/2009 |
| JP | 2003217697 | | 7/2003 |
| JP | 2010-049941 | | 3/2010 |

* cited by examiner

*Primary Examiner* — Khiem Nguyen
(74) *Attorney, Agent, or Firm* — Gerald E. Hespos; Michael J. Porco; Matthew T. Hespos

(57) ABSTRACT

A terminal fitting (10) includes a wire barrel (12) to be crimped and connected to a core (61) at an end portion of a wire (60). An insulation barrel (13) is located behind the wire barrel (12) and is to be crimped and connected to an insulation coating (62) at the end portion of the wire (60). The inner surface of the insulation barrel (13) is formed with a close-contact portion (18) to be held in close contact with the insulation coating (62) and a recessed groove (19) spaced from the insulation coating (62) and extending over the entire circumference. The recessed groove (19) has an opening (21) that is open at the front end of the insulation barrel (13) and a waterproof material (40) flows into the recessed groove (19) through the opening (21). The waterproof material (40) adheres to the outer surface of the core (61).

10 Claims, 5 Drawing Sheets

TERMINAL FITTING AND A METHOD FOR FORMING A FLUID-PROOF TERMINATED WIRE ASSEMBLY

BACKGROUND OF THE INVENTION

1. Field of the Invention

The invention relates to a terminal fitting and a method for forming a fluid-proof terminated wire assembly.

2. Description of the Related Art

Japanese Unexamined Patent Publication No. 2010-49941 discloses a terminal fitting formed by bending an electrically conductive metal plate and includes a wire barrel to be crimped and connected to a core at an end of a wire. An insulation barrel is located behind the wire barrel and is to be crimped and connected to an insulation coating at the end portion of the wire. The outer surface of the core is coated with a waterproof resin to ensure waterproofness of a connected part with the core. This waterproof material also is caused to flow into a recess defined by the rear end of the wire barrel, the front end of the insulation barrel and the outer surface of the core to adhere to the entire outer surface of the core.

In the above conventional terminal fitting, if a wire diameter becomes larger, an insulation barrel 1 bites in the outer surface of an insulation coating 3 of a wire 2 and, accordingly, a front end portion 4 of the insulation coating 3 may bulge radially out and widen, as shown in FIG. 5. Then, a step at the front end of the insulation barrel 1 disappears. Thus, the above-described recess is not formed and the waterproof material may not sufficiently adhere to a core 5. In view of this, widening the front end portion 4 of the insulation coating 3 can be avoided, for example, by reducing a projecting amount of a part of the insulation coating 3 that projects forward from the front end of the insulation barrel 1, i.e. a projecting margin A of the insulation coating 3. However, in this case, the front end of the insulation coating 3 may be located inside the insulation barrel 1 since it is difficult to adjust the projecting margin A. In such a case, the waterproof material does not spread to the inside of the insulation barrel 1 and may not adhere to a part of the core 5 located inside the insulation barrel 1.

The invention was completed in view of the above situation and an object thereof is to enable a fluidproof material to adhere reliably to the outer surface of a wire.

SUMMARY OF THE INVENTION

The invention relates to a terminal fitting formed by bending an electrically conductive plate material. The terminal fitting comprises a wire connection portion to be electrically connected to a core of a wire and at least one insulation barrel located behind the wire connection portion and to be crimped and connected to an insulation coating of the wire. The inner surface of the insulation barrel is formed with a close-contact portion to be held in close contact with the insulation coating and at least one recessed groove spaced apart from the insulation coating. The recessed groove has at least one opening that is open at or in communication with the front end of the insulation barrel so that a fluid- or liquid- or waterproof material can flow into the recessed groove through the opening and adhere to the outer surface of the core and/or insulation coating.

The inner surface of the insulation barrel is formed with the recessed groove spaced from the insulation coating and the fluidproof material can flow into the recessed groove through the openings. Thus, the fluidproof material spreads to the inside of the insulation barrel. As a result, the waterproof material reliably adheres to the outer surface of the core and/or insulation coating.

The recessed groove preferably extends over the entire circumference of the insulation coating and the fluidproof material adheres to the outer surface of the core and/or insulation coating over substantially the entire circumference of the wire.

The recessed groove preferably is formed within the plate thickness range of the insulation barrel. Thus, the insulation barrel does not have to be enlarged radially. As a result, the insulation barrel will not interfere with the inner surface of a cavity, for example, when the terminal fitting is inserted into the cavity of a connector housing.

The front end of the insulation coating preferably is to be located in the range of the recessed groove. Thus, the front end of the insulation coating is not widened and the waterproof material reliably adheres to the core. Further, it becomes unnecessary to adjust a projecting margin of the insulation coating, thereby reducing an operational burden.

The recessed groove preferably is strip-shaped in plain view and extends substantially straight.

The insulation barrel preferably has a larger projecting distance than the wire connection portion and/or a smaller dimension in forward and backward directions than the connection portion.

The wire connection portion preferably comprises at least one wire barrel to be crimped into connection with the core and at least one serration preferably is formed on an inner surface of the wire barrel.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
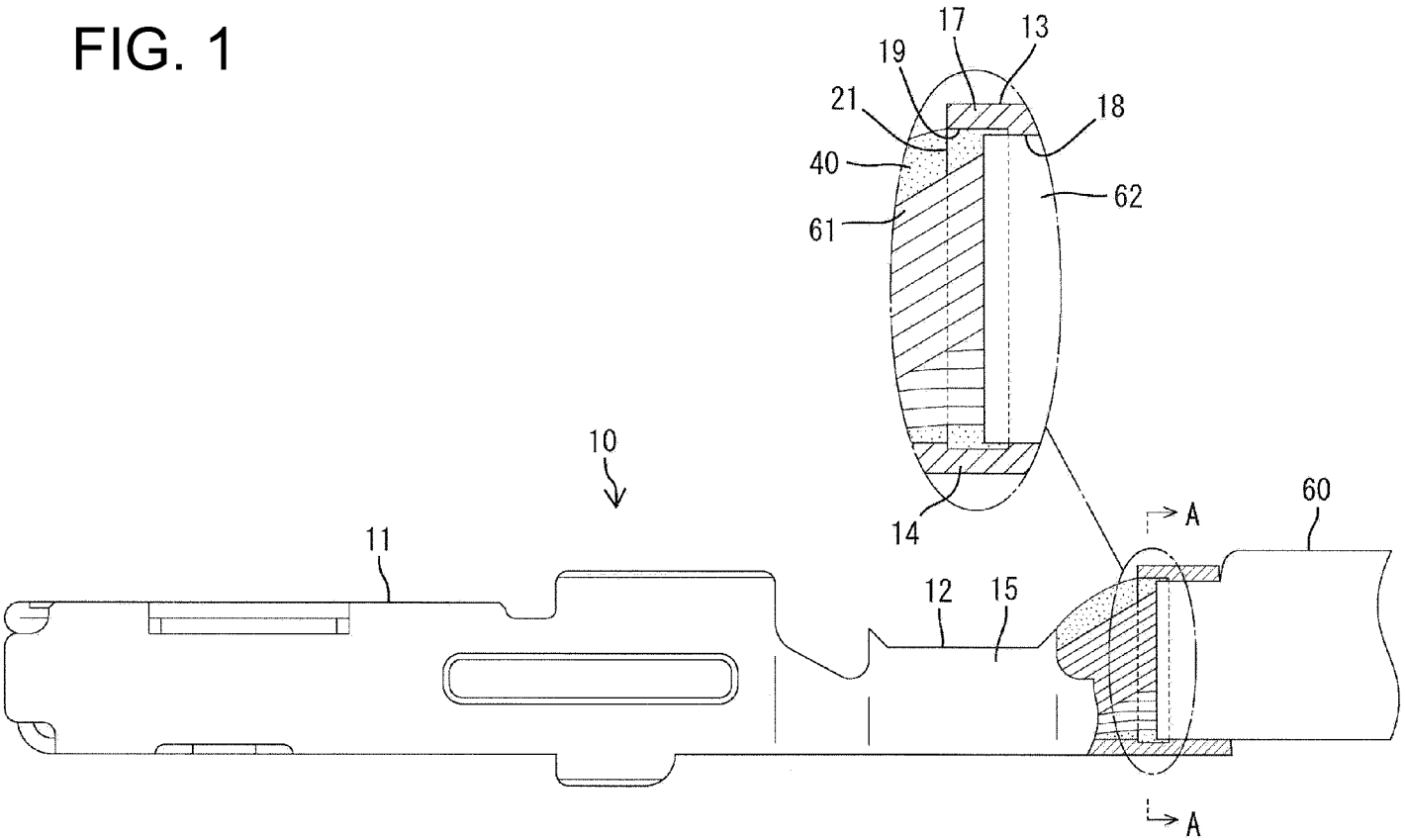
FIG. 1 is a side view of a terminal fitting according to one embodiment of the invention showing an essential portion in section.

A terminal fitting in accordance with the invention is identified by the numeral 10 and is formed unitarily by bending, folding and/or embossing process and the like on an electrically conductive plate made e.g. of copper or copper alloy and to be connected to an end portion of a wire 60.

The wire 60 comprises an electrically conductive core 61, for example, made of aluminum or aluminum alloy and an insulation coating 62 made e.g. of resin covering the core 61. The core 61 is exposed e.g. by stripping off the insulation coating 62 at the end portion of the wire 60.

A main portion 11 is formed at a front part of the terminal fitting 10 and is in the form of a substantially rectangular tube. An unillustrated resiliently deformable contact piece particularly is formed in the main portion 11. A male tab of an unillustrated mating terminal fitting is inserted into the main portion 11 as connectors are connected and resiliently contacts the resilient contact piece so that the two terminal fittings are connected electrically. It should be understood, however, that the invention is not limited to a female terminal fitting and can be applied equally to a male terminal fitting.

Figure 4:
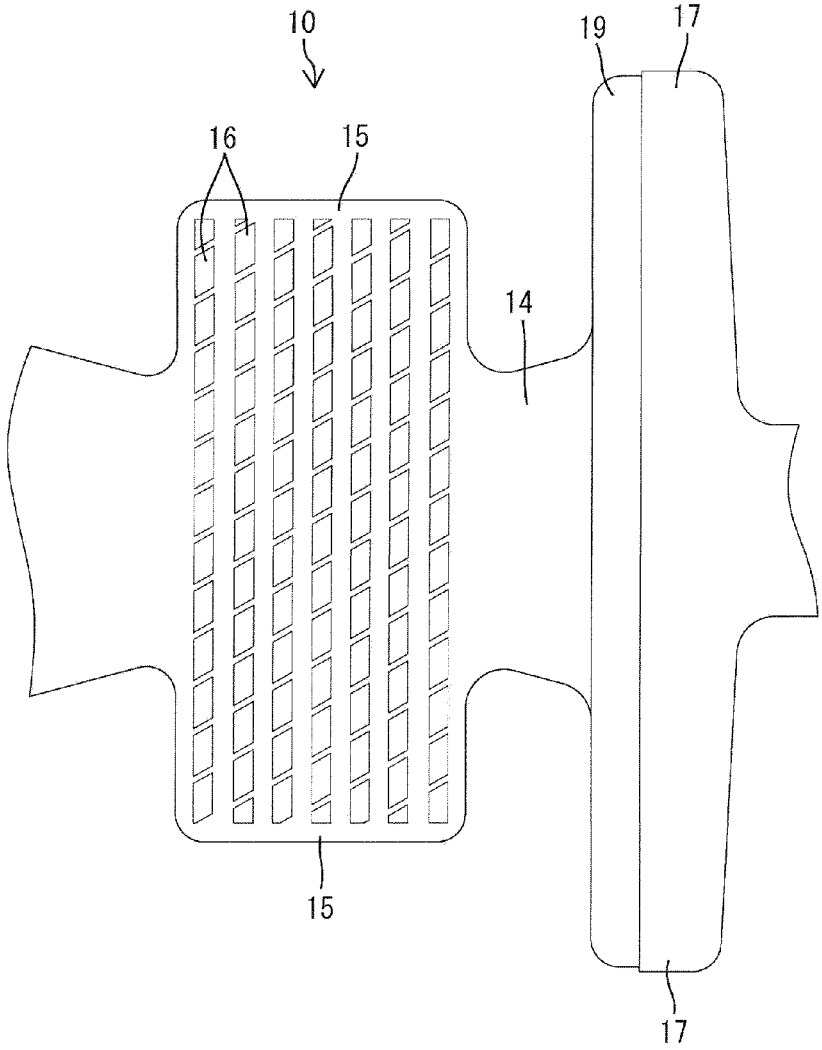
FIG. 4 is a development view showing an essential portion of the terminal fitting.
Figure 5:
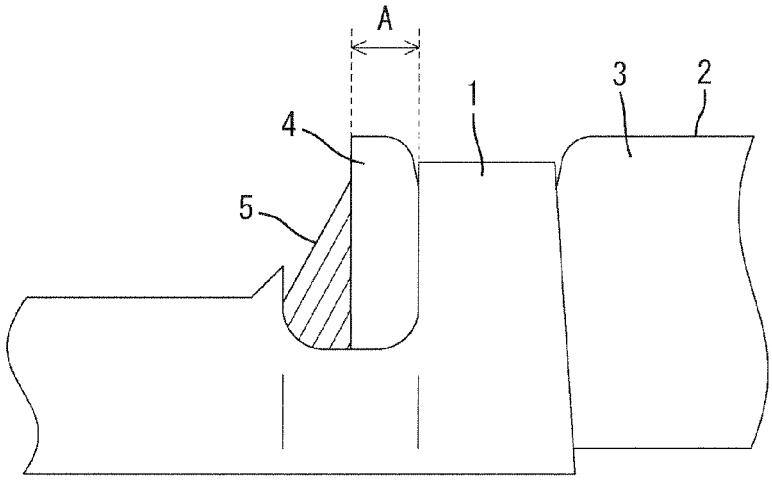
FIG. 5 PRIOR ART
FIG. 5 is a side view of a conventional terminal fitting showing an essential portion in section.

A wire barrel 12 and an insulation barrel 13 are formed one after the other at a rear part of the terminal fitting 10. A substantially strip-shaped base plate 14 extends over substantially the entire length of the terminal fitting 10 and supports the wire 60 in the wire barrel 12 and the insulation barrel 13. Two wire barrel pieces 15 project laterally projecting from opposite lateral sides of the base plate 14 at the wire barrel 12, as shown in FIG. 4, and are to be crimped, wound, bent or folded at least partly around the core 61 at the end portion of the wire 60 from opposite sides and are held in this state. Serrations 16 are formed in the entire inner surface of the wire barrel 12. The serrations 16 of the terminal fitting 10 lock the core 61 to hold the wire 60 firmly.

Figure 2:
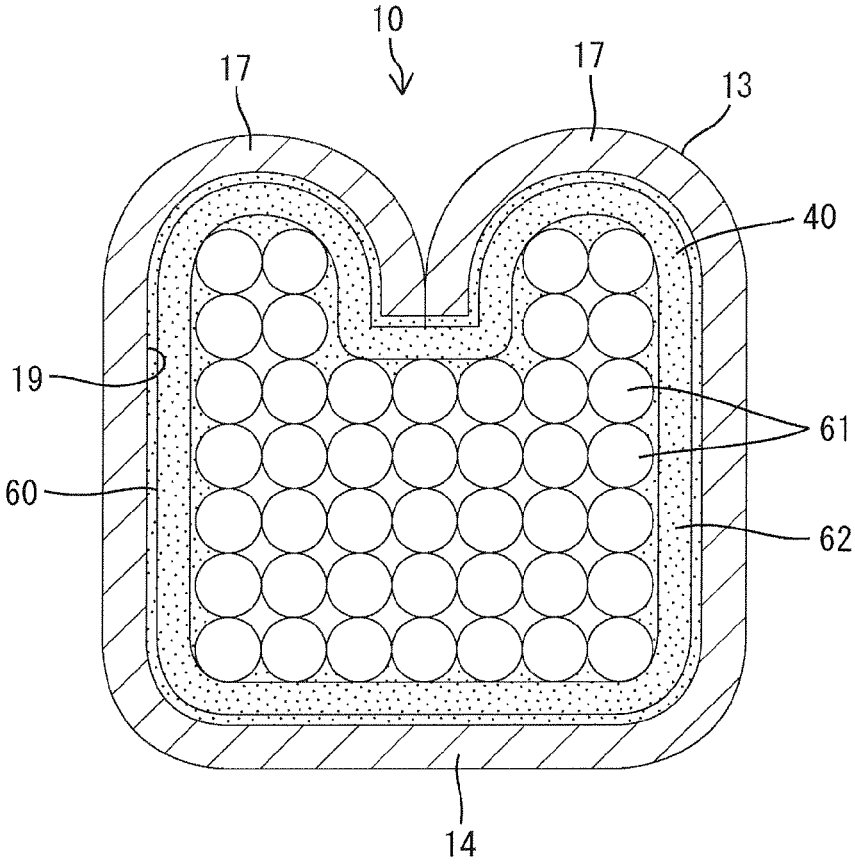
FIG. 2 is a section along A-A of FIG. 1.

The insulation barrel 13 includes two insulation barrel pieces 17 projecting laterally from opposite lateral sides of the base plate 14. The insulation barrel pieces 17 are to be wound, bent or folded at least partly around the insulation coating 62 near the end portion of the wire 60 from substantially opposite sides and held in this state. The insulation barrel pieces 17 have a larger projecting distance than the wire barrel pieces 15 and a smaller dimension in forward and backward directions than the wire barrel pieces 15. The insulation barrel pieces 17 have a substantially semicircular cross section and the outer peripheral surfaces of end edges thereof are held substantially in contact (see FIG. 2) when the insulation barrel pieces 17 are wound around the wire 60.

As shown in FIG. 1, at least one close-contact portion 18 and at least one recessed groove 19 are formed on the inner surface of the insulation barrel 13. The close-contact portion 18 is to be held in close contact with the outer surface of the insulation coating 62. However, the recessed groove 19 is spaced from the insulation coating 62 without contacting the outer surface of the insulation coating 62. The recessed groove 19 is formed at a front end portion of the insulation barrel 13 and the close-contact portion 18 is formed at or near a rear portion of the insulation barrel 13 excluding the recessed groove 19. The close-contact portion 18 is to be held in close contact with the outer surface of the insulation coating 62 over substantially the entire circumference.

The recessed groove 19 has a strip-shaped plan view extending straight over the entire widths of the base plate 14 and both insulation barrel pieces 17 (see FIG. 4). Further, the recessed groove 19 has at least one opening 21 that is open at the front ends of the insulation barrel pieces 17. With the insulation barrel 13 wound, bent or folded around the wire 60, the recessed groove 19 surrounds the insulation coating 62 over substantially the entire circumference without being held in contact with the insulation coating 62.

The recessed groove 19 is formed within the plate thickness range of the insulation barrel 13 by press-working the inner surface of the insulation barrel 13. More specifically, the recessed groove 19 has a dimension in forward and backward directions (groove width) smaller than about half the dimension of the insulation barrel 13 in forward and backward directions and a depth smaller than about half the thickness of the insulation barrel 13.

Figure 3:
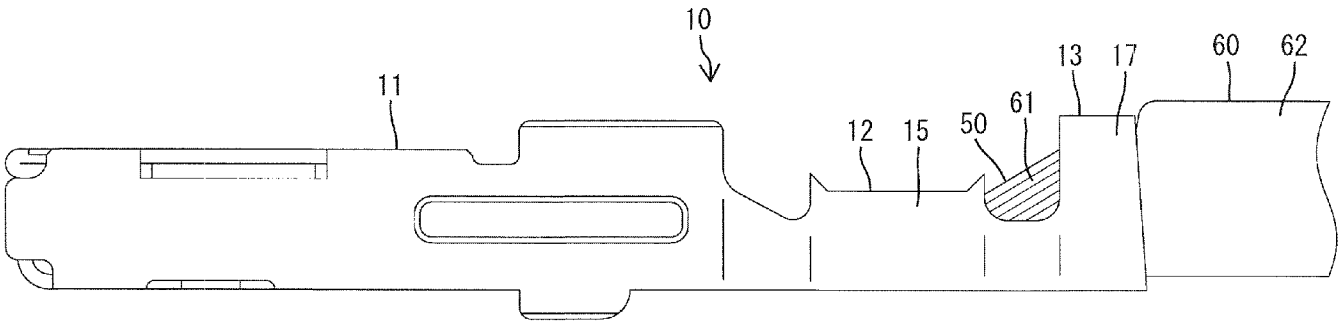
FIG. 3 is a side view of the terminal fitting.

The terminal fitting 10 is connected to the end portion of the wire 60 by crimping, folding or bending and connecting the wire barrel 12 to the core 61 and crimping, folding or bending and connecting the insulation barrel 13 to the insulation coating 62. The front end of the insulation coating 62 is arranged behind the front end of the insulation barrel 13 and in the recessed groove 19. Thus, as shown in FIG. 3, the front end of the insulation coating 62 is hidden in the insulation barrel 13 and is not radially widened. Further, with the terminal fitting 10 connected to the wire 60, a recess 50 is defined by the rear end of the wire barrel 12, the outer surface of the core 61 and the front end of the insulation barrel 13.

Subsequently, a fluid- or liquid- or waterproof material in a liquid state is adhered to the outer surface of the core 61. In this case, the waterproof material 40 is caused to flow into the recess 50 so that the waterproof material 40 reliably adheres to the outer surface of the core 61 located in the recess 50 and at least partly flows into the recessed groove 19 through the opening 21. Thus, the fluid- or liquid- or waterproof material adheres to the core 61 located in the insulation barrel 13 over substantially its entire circumference (see FIG. 2). Note that an anticorrosion material containing insulating resin such as silicon resin can be used as the waterproof material 40.

Thereafter, when the waterproof material 40 is cured, a coating area of the waterproof material 40 is formed on the outer surface of the core 61 to ensure waterproofness in a connected part and prevent the occurrence of electrical corrosion.

As described above, according to this embodiment, the recessed groove 19 spaced apart from the insulation coating 62 is formed in the inner surface of the insulation barrel 13 and the fluid- or liquid- or waterproof material 40 flows into the recessed groove 19 through the opening 21. Thus, the waterproof material 40 spreads also to the inside of the insulation barrel 13. As a result, the waterproof material 40 reliably adheres to the outer surface of the core 61.

The recessed groove 19 is formed within the plate thickness range of the insulation barrel 13. Thus, the insulation barrel 13 does not have to be radially enlarged. As a result, interference of the insulation barrel 13 with the inner surface of a cavity can be avoided when the terminal fitting 10 is inserted into the cavity of a connector housing.

The front end of the insulation coating 62 is located in the recessed groove 19. Thus, the waterproof material 40 also adheres to the part of the core 61 inside the insulation barrel 13. In this case, the front end portion of the insulation coating 62 is not widened and it is not necessary to adjust the projecting margin of the insulation coating 62.

The invention is not limited to the above described and illustrated embodiment. For example, the following embodiments are also included in the technical scope of the present invention.

The core of the wire and the terminal fitting may be made of the same type of metal (e.g. both are made of copper or copper alloy).

The invention is also applicable to male terminals in which a male tab projects forward.

The invention is also applicable to a terminal fitting being electrically connected to the core of the wire by insulation displacement or any other means such as soldering, welding, gluing or the like.

What is claimed is:

1. A terminal fitting formed by bending an electrically conductive plate material, the terminal fitting extending in a forward to rearward direction and comprising:

a wire connection portion to be electrically connected to a core of a wire; and at least one insulation barrel rearward of the wire connection portion and to be crimped and connected to an insulation coating of the wire, an inner surface of the insulation barrel being formed with a close-contact portion to be held in close contact with the insulation coating and at least one recessed groove forward of the close-contact portion and spaced from the insulation coating when the at least one insulation barrel is crimped and connected to the insulation coating of the wire; wherein the recessed groove forms at least one opening at a forward-facing end of the insulation barrel when the insulation barrel is crimped and connected to the insulation coating of the wire so that a fluidproof material can flow through the opening and between the recessed groove and the wire and adhere to at least one of an outer surface of the core and the insulation coating.

2. The terminal fitting of claim 1, wherein the recessed groove extends over an entire circumference of the insulation coating.

3. The terminal fitting of claim 2, wherein the recessed groove is formed within a plate thickness range of the insulation barrel.

4. The terminal fitting of claim 2, wherein a front end of the insulation coating is to be located in the recessed groove.

5. The terminal fitting of claim 2, wherein the recessed groove has a substantially straight strip-shape in plain view.

6. The terminal fitting of claim 2, wherein the insulation barrel has a larger projecting distance than the wire connection portion and a smaller dimension in forward and backward directions than the wire connection portion.

7. The terminal fitting of claim 1, wherein the wire connection portion comprises at least one wire barrel to be crimped into connection with the core, at least one serration being formed on an inner surface of the wire barrel.

8. A terminated wire assembly, comprising:

a wire having a core exposed at an end of the wire and an insulation coating covering the core at locations spaced from the end of the wire;

a terminal fitting extending in forward and backward directions and having a wire connection portion crimped into electrical connection with the core of the wire, and an insulation barrel rearward of the wire connection portion crimped into connection with the insulation coating of the wire, the inner surface of the insulation barrel having an inner surface with a close-contact portion to be held in close contact with the insulation coating and at least one recessed groove forward of the close contact portion and spaced from the insulation coating, the recessed groove forming at least one opening at an end of the insulation barrel nearest the wire connection portion; and a fluidproof material inserted through the opening and between the recessed groove and the wire and adhering to at least one of an outer surface of the core and the insulation coating of the wire.

9. The terminated wire assembly of claim 8, wherein the recessed groove extends over an entire circumference of the insulation of the insulation coating.

10. The terminated wire assembly of claim 9, wherein the recessed groove is formed within a plate thickness range of the insulation barrel.

* * * * *